United States Patent [19]

Regitz

[11] 3,986,902

[45] Oct. 19, 1976

[54] SILICON STEEL SUITABLE FOR PRODUCTION OF ORIENTED SILICON STEEL USING LOW SLAB REHEAT TEMPERATURE

[75] Inventor: Lester J. Regitz, Penn Township, Westmoreland County, Pa.

[73] Assignee: United States Steel Corporation, Pittsburgh, Pa.

[22] Filed: Oct. 9, 1975

[21] Appl. No.: 621,094

Related U.S. Application Data

[63] Continuation-in-part of Ser. No. 472,244, May 22, 1974, abandoned.

[52] U.S. Cl. ..... 148/110; 148/111; 148/112

[51] Int. Cl.[2] ..... H01F 1/04

[58] Field of Search ..... 148/110, 111, 112, 31.55; 75/123 L

[56] References Cited

UNITED STATES PATENTS

| | | | |
|---|---|---|---|
| 3,159,511 | 12/1964 | Taguchi et al. | 148/111 |
| 3,671,337 | 6/1972 | Kumai et al. | 148/111 |
| 3,695,946 | 10/1972 | Demeaux | 148/111 |
| 3,764,406 | 10/1973 | Littmann | 148/111 |

*Primary Examiner*—Walter R. Satterfield
*Attorney, Agent, or Firm*—Forest C. Sexton

[57] ABSTRACT

A process for producing grain oriented silicon sheet steel having excellent magnetic properties in which the manganese and sulfur contents are critically controlled so that the product of manganese content, in weight percent, times sulfur content, in weight percent, is within the range 0.0007 to 0.0012, and aluminum is added to the deoxidized steel just prior to teeming to minimize the formation of insoluble oxide precipitates within the body of the teemed steel, the amount of aluminum added being limited so as to avoid appreciable aluminum remaining in solution in the teemed steel. The slab resulting from the above steel can then be preheated to a temperature of 2,130° to 2,390° F prior to hot rolling without sacrificing magnetic quality.

7 Claims, 1 Drawing Figure

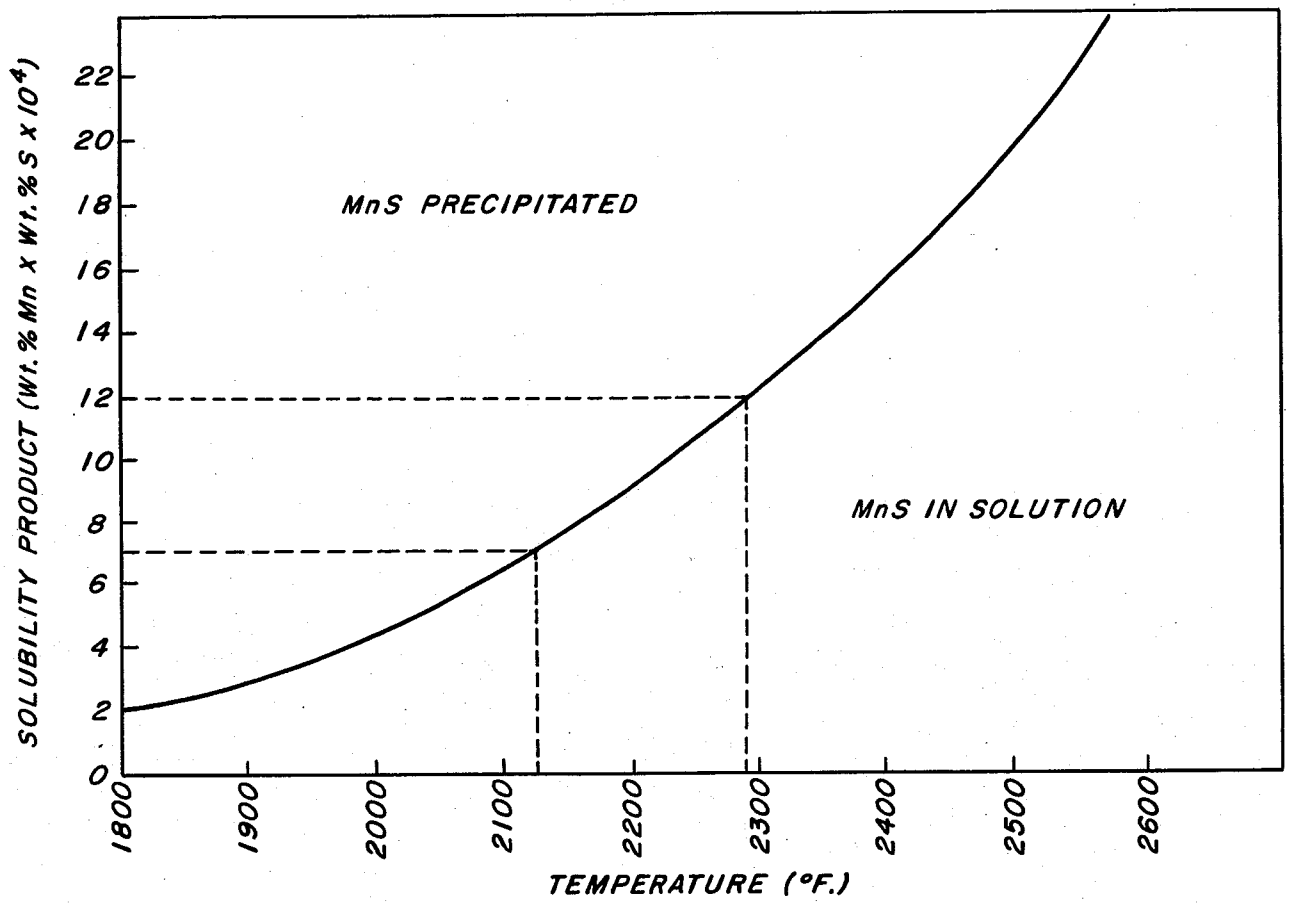
MnS PRECIPITATED
MnS IN SOLUTION
TEMPERATURE (°F.)
1800
1900
2000
2100
2200
2300
2400
2500
2600
SOLUBILITY PRODUCT (Wt.% Mn x Wt.% S x 10⁴)
0
2
4
6
8
10
12
14
16
18
20
22

SILICON STEEL SUITABLE FOR PRODUCTION OF ORIENTED SILICON STEEL USING LOW SLAB REHEAT TEMPERATURE

CROSS-REFERENCE TO RELATED APPLICATION

This application is a continuation-in-part of application Ser. No. 472,244, filed May 22, 1974, now abandoned.

BACKGROUND OF THE INVENTION

Processes for producing grain oriented silicon sheet steels, as used in transformers and other electromagnetic devices, must be carefully controlled to assure a maximum degree of an easily magnetized preferred orientation in the final product and accordingly optimum isotropic magnetic properties. Basically, current commercial processes involve production of a steel having a very carefully controlled chemistry, typically 2.5 to 3.5% silicon, 0.07 lto 0.12% manganese, about 0.025% sulfur, less than 0.03% carbon, and less than 0.015% phosphorus. Slabs of this steel are hot rolled to a hot-band gauge of about 0.08-inch. Thereafter, the hot-rolled steel is cleaned and cold rolled to final gauge using one of various practices. Usually, cold rolling involves two cold reductions to a final gauge of between 0.010 to 0.015 inch with an intermediate anneal. The cold rolled sheet is then given a decarburizing anneal to effect primary recrystallization and decarburization, and thereafter given a final, carefully controlled, high temperature box anneal to effect a secondary recrystallization to the preferred orientation.

The production of a well developed oriented microstructure is dependent not only on a careful control of the interrelated processing parameters, but also on a careful control of metal chemistry. For example, it is well known in the art that a fine, dispersed, precipitated phase, such as manganese sulfide, must be present during the final orientation anneal to function as a grain growth inhibitor, and accordingly promote an oriented secondary recrystallization. Without such a precipitate, the final anneal will cause considerable grain growth of the larger primary grains with little or no secondary recrystallization to an oriented microstructure. On the other hand, such a precipitated phase is not beneficial unless it is precipitated during or after hot rolling of the slab to sheet, because prior hot treatments, blooming, etc., will cause such precipitates to be rather large, and not well dispersed, throughout grains of the hot-rolled sheet. To avoid this problem, commercial practices utilize a relatively high temperature preheat for slab hot rolling, i.e., temperatures of about 2500° F, in order to dissolve the particles of the precipitated phase to be thereafter re-precipitated during or after hot rolling.

Although the above high temperature hot rolling practice is effective in dissolving sulfides included in the steel, so that they might subsequently be precipitated, as grain growth inhibitors, this practice is costly, time consuming, and troublesome, particularly with respect to the destructive effects of such high temperatures on the slab reheating furnace ceramic lining and supporting structure, and to the excessive oxidation of the surfaces of slabs being so heated. Indeed, considerable research efforts have been directed towards development of processes not necessitating such high slab reheat temperatures. Several such processes have been proposed or patented. These processes usually rely on using other precipitates for grain growth inhibitors or combinations thereof. None of these processes however have been reduced to commercial practice.

Recently it has been taught (U.S. Pat. No. 3,671,337, Ko Kumai et al.) that lower slab reheating temperatures can be used by reducing the amount of manganese sulfide in the steel provided that an aluminum nitride phase is present in sufficient amounts to augment the manganese sulfide as a grain growth inhibitor. Although exceptionally good results can be achieved with this process, it is more costly due to the necessity for exacting controls and the fact that yield of prime product is somewhat low. In addition, the high aluminum content appears to be troublesome during teeming due to reoxidation thereof in the absence of extraordinary precautions during teeming.

In other more recent developments it has been taught (U.S. Pat. No. 3,802,937, D. M. Kohler et al) that lower manganese sulfide contents will provide sufficient grain growth inhibition thus permitting lower slab-reheat temperatures, provided that the steel's oxygen content is no greater than 0.0045%. It is believed that in the absence of oxide nucleation sites, the sulfide phase is more finely dispersed. To this end therefore, the steel must be vacuum treated after tapping to assure a sufficiently low oxygen content, a costly and time consuming process.

SUMMARY OF THE INVENTION

This invention is predicated on my development of a new and improved process for making grain oriented silicon sheet steel which permits lower slab reheat temperatures prior to hot rolling, without sacrificing prime product yield and without the need for vacuum treatment processing. The use of lower slab reheating temperatures will yield many advantages including: reducing the heat input to the reheating furnace, reducing slab distortions during reheating, reducing slab "sweating," or oxidation rate and extent, reducing yield losses caused thereby, decreasing slag accumulations in the furnace, decreasing damage to the furnace lining and structure to increase duration of furnace campaign, increasing furnace push rates to thereby increase productivity, increasing life of rolls and hot rolling mills, and decreasing duration of sulfur removing shelf temperature during box annealing to increase productivity of existing box annealing facilities.

Like the above-mentioned Kohler et al process, this invention is predicated on minimizing oxide nucleation sites which interfere with fine dispersion of the manganese sulfide thus permitting a lower amount of the sulfide. Unlike that process however, this invention does not require expensive vacuum treatment of the molten steel, but rather is based on utilization of conventional deoxidation techniques such as conventional aluminum deoxidation followed by a further addition of aluminum just prior to teeming to prevent iron and, to a significant extent silicon from oxidizing during the teeming operation.

An object of this invention is to provide a new and improved process for producing grain oriented silicon sheet steel which will permit lower slab reheating temperatures to render the above listed advantages.

Another object of this invention is to provide a process for producing grain oriented silicon sheet steel which utilizes a low manganese and/or sulfur content in combination with low residual oxide contents to permit lower slab reheating temperatures without detriment to the product's magnetic qualities.

A further object of this invention is to provide a process for producing grain oriented silicon sheet steel utilizing an effective deoxidation step combined with protective measures to prevent reoxidation to thereby allow lower amounts of manganese-sulfide precipitates to be effective grain growth inhibitors, and hence permit lower slab reheat temperatures prior to hot rolling.

BRIEF DESCRIPTION OF THE DRAWING

The attached drawing graphically illustrates the solubility product for manganese suldife as a function of temperature.

DESCRIPTION OF THE PREFERRED EMBODIMENT

It has already been noted that in the production of grain oriented silicon sheet steel, the development of a good oriented microstructure during the final anneal depends upon presence of a fine, dispersed precipitated phase throughout primary grains. These precipitates, when present in sufficient quantities, serve as grain growth inhibitors during the final anneal and thereby promote a secondary recrystallization rather than unselective grain growth of the primary grains through boundary migration. Although several different forms have been proposed for these precipitates, e.g., VN, TiC, MnS, the most common commercial practice has been to utilize manganese sulfide precipitates, because the constituents thereof are already present in the steel and the amount thereof can be readily controlled. According to these prior art practices therefore, it has been necessary to provide a silicon steel containing from 0.07 to 0.11% manganese and 0.020 to 0.040% sulfur. With these quantities of manganese and sulfur, sufficient manganese sulfide will generally be formed, and available to provide the necessary grain growth inhibiting precipitate, i.e., (between about 0.055 to 0.11% MnS).

To be an effective grain growth inhibitor, it is known that the manganese sulfide, or any such precipitated phase, must be finely dispersed in the steel, where the minute particles serve as "pins" to prevent grain boundary migration and hence grain growth during primary recrystallization and promote grain growth of the {110} <001> grains only during secondary recrystallization. Extensive hot working of the solidified steel will cause these precipitates to grow appreciably and be concentrated intergranularly such that the precipitates will not function as desirable grain growth inhibitors. Therefore, it is further essential that the precipitated phase be one that can be dissolved in solid solution, and that it is so dissolved during slab reheat, so that it will be reprecipitated as finely dispersed particles during or after the final hot rolling step, i.e., slab rolling to hot band gauge.

It can be seen, in the prior art practice described above, that an excess of manganese, above that required for a stoichiometric reaction with sulfur to form MnS, is present in the prior art steel. For example, 0.020% sulfur, as indicated in the above description, would react almost completely with about 0.035% manganese to leave a considerable amount of unreacted manganese. This excess manganese is helpful in preventing hot-shortness in the steel. However, since the excess manganese is present in solution in the solidified steel, it also reduces the ease with which precipitated manganese sulfide can be dissolved upon slab reheating. The difficulty of dissolving the precipitated manganese sulfide is proportional to the amount of excess, unreacted manganese already in solution.

Since the process of solution of manganese sulfide is a thermally activated reaction, it can be represented by the conventional reaction equation $$MnS \longrightarrow [Mn]_{Fe} + [S]_{Fe}$$

wherein precipitated MnS, during the process of solution becomes manganese and sulfur individually dissolved in solid steel. In accordance with conventions for considering the energy relationships in such reactions, the tendency for such solution reactions can be expressed:

$$\frac{[\%Mn]\,[\%S]}{\%MnS}$$

considering the activity of precipitated MnS to be constant, the difficulty of dissolving MnS can be seen to be proportional to the product %Mn times %S, which is termed the "solubility product". In the case in point, the larger the solubility product, the greater the temperature required for complete solution. Accordingly, an excess of manganese content, above that required for a stoichiometric combination of manganese and sulfur, increases the solubility product, and therefore the temperature required for complete solution. For a more detailed discussion on solubility product, see *Metallurgical Thermochemistry*, O. Kubachewsky and E. Evans, John Wiley and Sons, New York, 1956, pp. 32–72.

From the above it follows that if the amount of manganese sulfide in the steel is reduced, then a lower slab reheat temperature could be used for total dissolution thereof. For example, a conventional prior art steel slab to be processed into grain oriented silicon sheet steel, will typically contain about 0.08 wt. % manganese and 0.025 wt. % sulfur to yield a solubility product of about 0.002 wt. % manganese times wt. % sulfur. In order to dissolve substantially all of this sulfide into solid solution, the slab must be heated to a temperature in excess of 2,400° F, and preferably 2,500° to 2,550° F. In the case of the minimum manganese and sulfur contents cited from prior art, above, the solubility product is 0.0014, requiring a minimum slab-reheat temperature of about 2,350° F. As already noted, such high reheat temperatures are indeed troublesome. On the other hand, if a solubility product of less than 0.0012, i.e. wt. % manganese times % sulfur, is present in the steel, then a temperature of 2290° F or less will be sufficient to dissolve substantially all of the sulfide. Although such low slab reheat temperatures would indeed be advantageous, such a low amount of manganese sulfide will not normally be an effective grain growth inhibitor, if the steel is otherwise processed in accordance with prior art practices.

As noted above, it has been shown that the effectiveness of manganese sulfide as a grain growth inhibitor, as necessary to promote orientation during the final anneal, is adversely affected by the presence of insoluble precipitated oxidation products, such as $Al_2O_3$, $SiO_2$, MnO, $FeSiO_3$, etc., which are dispersed throughout the steel. Although the reasons for this adverse effect are not completely understood, I believe it is due to the oxide's very low solubility in solid steel, particularly at the low slab-reheat temperatures utilized in this process, and/or the tendency of sulfur to be associated with such oxides in the form of oxy-sulfides, the solubility limits and kinetics of which are less effective in allowing the development of desired preferred orientation. Because these grain oriented steels necessarily have high silicon contents, they are always cast in the killed state and accordingly, such oxidation products are always present to some extent. I have found however, that the more troublesome oxidation products are those reoxidation products formed during teeming as discussed below.

The above phenomenon was in part recognized by the above mentioned Ko Kumai et al patent, which teaches that silicious inclusions are harmful, and accordingly, that lower manganese sulfide contents will be effective grain growth inhibitor if the steel is deoxidized with aluminum in amounts sufficient to avoid silicon consumption and at the same time render more than 0.005 wt. % acid soluble aluminum in the steel to form aluminum nitride. The aluminum nitride is said to supplement the low manganese sulfide content, so that the manganese sulfide and aluminum nitride will coexist to form a sufficient amount of precipitate as necessary to produce optimum grain orientation.

In a like manner, the above phenomenon was perhaps completely recognized by the above-mentioned Kohler et al patent which teaches that oxide inclusions are harmful, and accordingly, that lower manganese-sulfide contents will be effective as a grain growth inhibitor if the steel is deoxidized to exceptional low levels prior to teeming.

The process of this invention is similar in that lower amounts of manganese sulfide are used and oxide nucleation is minimized. However, aluminum nitride is not necessary or desired in this process nor is a vacuum deoxidation required. Rather, the process of this invention utilizes procedures designed merely to protect the deoxidized steel during teeming. That is, avoid insoluble reoxidation products formed during teeming.

According to the preferred practice of this invention, a heat of steel is refined in any refining vessel such as an open hearth, Q-BOP or BOF according to prior art practices to yield a low carbon steel. Commercial specifications typically require 0.02 to 0.04% max. carbon, 0.010% max. phosphorus, 0.010% max. copper, 0.06% max. nickel, 0.06% max. chromium, 0.010% max. molybdenum, 0.015% max. tin, and of course manganese and sulfur as described above. Here however, the manganese and/or sulfur contents however, must be lower than conventional prior art practice so as to yield a lower quantity of manganese sulfide in the steel prior to slab reheat. Typically, prior art practices provide a steel having 0.08 to 0.10 wt. % manganese and about 0.025 wt. % sulfur. In the cooled steel, this will yield about 0.068 wt. % manganese sulfide, and a solubility product from 0.0020 to 0.0025. It is essential to this process, however, that the solubility product be no more than 0.0012 wt. % manganese tims wt. % sulfur, and preferably, between 0.0007 to 0.0010. To this end, it is necessary to reduce the amount of either or both of these reactants in the steelmaking process. For example, a manganese content of 0.05 wt. % and/or a sulfur content of 0.020 wt. % will be sufficient to yield a solubility product of about 0.0010. The following table, convenient in view of the state of the art of controlling these reactants during steelmaking, will further exemplify alternative workings of this invention.

| Weight Percent Manganese in Molten Bath | Permissible Weight Percent Sulfur |
|---|---|
| 0.08 | 0.009 to 0.013 |
| 0.07 | 0.011 to 0.015 |
| 0.06 | 0.012 to 0.018 |
| 0.05 | 0.015 to 0.022 |
| 0.04 | 0.019 to 0.023 |

Reduced manganese contents, in such a process, can be realized by selecting low-manganese scrap and hot metal prior to steelmaking, extending the duration of oxygen introduction or increasing the efficiency of manganese oxidation during steelmaking, and/or reducing the amount of manganese used during deoxidation of the steel bath.

Reduced sulfur contents, in such a process, can be obtained through similar metal selection and steelmaking processes and/or through use of various practices available for desulfurization of molten steel before or during teeming.

Although each of the ranges of sulfur content shown in the foregoing table, in conjunction with the indicated manganese content, is appropriate for the practice of this invention, it is of additional benefit, and therefore desirable to minimize the sulfur content, and thereby allow some excess manganese content. This will then facilitate desulfurization during the final anneal, i.e. less sulfur needs to be removed during the final anneal with the result that the steel's magnetic properties will be optimized. For example, it is of additional benefit, for a more economical final anneal, to make a steel having a manganese content of about 0.07 or 0.08 wt. %, with sulfur contents of about 0.011 to 0.015 wt. % or 0.009 to 0.013 wt. % respectively. Such selections of relative manganese and sulfur contents, from those listed in the above table, would provide a manganese content in excess of that required for stoichiometric considerations, and therefore insure the most complete consumption of available sulfur by formation of manganese sulfide.

After the desired hot metal chemistry is achieved in the steelmaking furnace, the steel is tapped and deoxidized in accordance with conventional procedures. Typically, a combination of ferrosilicon, aluminum and manganese are added to the tap ladle. In addition, carbon and/or sulfur may be added for the purpose of adjusting the chemistry of the steel.

After the steel has been fully killed, i.e., deoxidized as described above, and the manganese, sulfur and carbon contents adjusted to the desired level, a ferrosilicon addition is made, usually to a second ladle to effect the proper silicon alloy content. A final ferrosilicon addition may be subsequently made, if necessary, to the teeming ladle.

In conventional prior art practices, the steel is teemed into ingot molds once the silicon is thoroughly mixed-in. The crux of this inventive process however is the provision of one additional step after the silicon is added but before the steel alloy is teemed, namely the step of adding aluminum to the steel for the purpose of preventing the deoxidized steel from forming harmful reoxidation products during teeming. To clarify this point, it should be noted that when conventional silicon steels are teemed, the narrow teem stream exposes a rather large surface area of clean molten steel of low oxygen content to the oxygen-containing atmosphere. As a result of this exposure, a sustantial degree of reoxidation of the steel constituents takes place, forming the harmful insoluble oxides as discussed above. That is, these insoluble oxides are concentrated in the body of the steel ingot and adversely affect the effectiveness of the manganese sulfide precipitates as grain growth inhibitors. Accordingly, in order that the lower amount of manganese sulfide may be an effective grain growth inhibitor in subsequent heat treatments, the amount of insoluble reoxidation products formed during teeming must be minimized. To this end, it would appear that teeming in an inert atmosphere would suitably protect the steel from reoxidation. Rather than utilize the costly and burdensome procedures required for controlled atmosphere teeming however, I have learned that if a second addition of aluminum (assuming aluminum was used to deoxidize the steel), or in any event, an aluminum addition made to the steel after it has already been deoxidized and after the silicon is added, this soluble aluminum in the steel will very effectively protect the iron and, to some extent, silicon constituents therein from partial reoxidation during teeming. Accordingly, the preferred practice of this invention is to provide such a "protective" aluminum addition to the molten steel prior to teeming. To explain this, it should be noted that prior art deoxidation practices add aluminum or other deoxidizers to the tap ladle during furnace tapping or immediately thereafter. This will effectively kill or deoxidize the steel, typically to the point where the steel contains from 70 to 80 ppm oxygen. Unlike the above-mentioned Kohler et al process wherein this oxygen content is further lowered to below 0.0045%, by vacuum treatment, this process retains this oxygen content as is, and provides for a further aluminum addition between the silicon addition and teeming. Since the steel has already been deoxidized, such as by conventional aluminum deoxidation and a very substantial amount of silicon added, silicon itself being a very strong deoxidizer, the "protective" aluminum addition does not effect any deoxidation of the steel. Rather essentially all of this aluminum goes into the steel as soluble aluminum, to eventually be oxidized during teeming and hence, protect the iron and silicon constituents from such oxidation. The lateness of the aluminum addition serves to minimize aluminum oxidation reactions within the steel to assure sufficient availability of unreacted soluble aluminum during teeming. During teeming therefore, there is a preferential oxidation of the aluminum contained in the steel, as opposed to that of the other oxidizable constituents. The products of this reaction tend to accumulate into large viscous masses which readily float on top of the teemed ingot, and are not therefore dispersed within the ingot as are the normal reoxidation products formed during teeming.

With reference to the above considerations, I have found that at least about 0.15 pounds of aluminum per ton of steel must be added in order to achieve sufficient oxidation protection during teeming. On the other hand, an excessive amount of residual soluble aluminum remaining in the steel ingot after teeming would be detrimental. Surprisingly, however, substantially all of the protective soluble aluminum added is oxidized during teeming. Indeed, although as much as 0.52 pounds of aluminum per ton of steel has been added, the resulting soluble aluminum remaining in the steel after teeming is about 0.003 wt. %. This is essentially the same amount that would have been present had the protective aluminum addition not been made. That is, the prior art practice normally results in a residual soluble aluminum content of about 0.003 wt. %. It is clear therefore that essentially all the protective aluminum added according to this invention, at least in amounts up to 0.52 pounds per ton, is indeed oxidized during teeming. Hence, by maintaining the aluminum addition within the range of 0.15 to 0.52 pounds per ton harmful oxidation products can be avoided and there is no danger that a harmful excessive residual soluble aluminum content will remain after teeming. Although it is not anticipated that any benefit would be derived from protective aluminum additions in excess of 0.52 pounds per ton, there is no reason to believe that such excessive amounts would not work equally well to protect against undesirable oxidation products, or that such excessive amounts of aluminum will not all be oxidized so as to yield suitable final soluble aluminum contents. It should be understood that the upper limit of 0.52 pounds per ton is not critical, and hence operable amounts in excess thereof are deemed to be within the scope of this invention.

After the steel is effectively deoxidized and teemed as described above, the resulting ingot is processed according to conventional practices. This involves soaking the ingot at about 2,400° F and hot rolling it into a slab.

Before the slab is hot rolled to hot band gauge, it is of course necessary that the slab be reheated, and in accordance with prior art practices, the slab must be reheated to a temperature sufficient to dissolve substantially all of the manganese sulfides into solid solution. However, because of the MnS solubility products of slabs of this process range only from 0.0007 to 0.0012, a slab reheat temperature between 2,130° to 2390° F, and preferably (for a solubility product less than 0.0010) less than 2,290° F will be sufficient. This, of course, is where the primary advantages of this invention are realized. The relationship between necessary equilibrium solution temperature and solubility product is shown in FIG. 1. Practical minimum reheat temperatures, as given above, have been found to be slightly higher than those minimum equilibrium temperatures for each solubility product shown.

The protection from reoxidation taught herein allows concentrations of manganese sulfide which are significantly lower than concentrations heretofore believed necessary to prevent random grain growth. This protection from reoxidation also allows reduction of the manganese-to-sulfur ratio as low as about 1.70 from that previously found necessary (about 3.0) to prevent hot brittleness in silicon steel.

When the slab has been suitably reheated as described above, it is hot rolled to hot band gauge according to conventional prior art practices. This usually involves reduction to sheet having a thickness between 0.050 to 0.100 before the temperature is reduced to between 1,450° and 1,750° F, and water-spray-cooling the sheet to between 850° and 1,050° F prior to coiling the hot-rolled sheet.

After the hot band is suitably pickled and cleaned, it is cold rolled to final gauge, usually about 0.011 inch with or without a suitable, intervening normalizing anneal. To effect such a reduction, it is necessary to provide two individual cold reductions with a softening intermediate anneal. In order to optimize orientation in the final product, it is necessary that the second cold rolling should effect a thickness reduction of from 44 to 56%, and preferably 50 to 52% in order to obtain a desirable optimum preferred orientation. Therefore, if a gauge of 0.011 inch is desired for the final product, it is necessary that the first cold-rolling reduce the steel to between 0.022 and 0.023-inch thick, so that the second cold-rolling to 0.011 inch will approximate 50 to 52% reduction.

After cold rolling, the steel is finished according to conventional prior art practices. This usually involves a decarburizing anneal at 1,400° to 1,500° F to effect at 0.007 max. % carbon and which also affects primary recrystallization. And finally a high-temperature box anneal about 1,950° to 2,150° F to effect secondary recrystallization, during which almost complete (110)[001] texture is developed.

It was noted above that the hot band may or may not be normalized prior to cold rolling. Such normalizing practices are of course not common in prior art practices. Although normalizing is not essential in the process of this invention, such as normalizing procedure has been shown to be beneficial in this process for optimizing magnetic properties in the finished product. Ideally such a normalizing step involves a continuous normalizing heat treatment for about one minute at a temperature of at least 1,800° F prior to any cold rolling. Thereafter in the intermediate anneal following the first cold reduction, a somewhat lower annealing temperature is preferred. That is, whereas conventional practices without a normalizing step provide an intermediate anneal at 1,700° to 1,750° F, this anneal is preferably at 1,600° to 1,650° F if the normalizing step is included.

EXAMPLE

A BOF steel heat was produced, deoxidized and alloyed to the following composition just prior to teeming:

| | | |
|---|---|---|
| Carbon | 0.031% | |
| Manganese | 0.055% | |
| Phosphorus | 0.006% | |
| Sulfur | 0.020% | |
| Silicon | 2.97% | |
| Aluminum | 0.002% | (total) |
| Nitrogen | 0.005% | |

Immediately preceeding the teeming of this steel, about 0.0078 wt. % aluminum was added, or about 0.156 pound per ton of finished steel. Surprisingly, the final aluminum content of the solidified steels (0.002 wt. %) was no greater than that for conventionally-produced silicon steels (0.002 to 0.004 wt. %). Ingots made from such steels were soaked at about 2,400° F and rolled to 6-½-inch-thick slabs. Various slabs were reheated to between 2,150° and 2,390° F and rolled to 0.080-inch-thick sheet. Hot-rolled sheets were subsequently processed to 0.011-inch-thick sheet, as taught herein, employing a first anneal of 2 minutes at 1,600° F, reduction of 50 to 52%, and a second decarburizing anneal of 5 minutes at 1,475° F, a box anneal for 7.5 hours at 2,150° F, and tested according to procedures defined in Procedure A343-60T of "ASTM Standards Relating to Magnetic Properties," ASTM, 1916 Race Street, Philadelphia, Pa. For sheets produced from slabs reheated to between 2,260° and 2,270° F, test core losses at 17 Kilogauss ranged from 0.686 to 0.746 watts per pound at 60 Hertz, all of which values are acceptable by industry for application as M-4 grade oriented electrical sheet steel. The 15 Kilogauss core losses for such sheets were between 0.462 and 0.525 watts per pound at 60 Hertz. The 17 Kilogauss permeabilities ranged between 10,761 and 12,500, and 15 Kilogauss permeabilities ranged between 28,304 and 30,000. Permeability at a 10 Oersted exciting field strength was about 1860 for all such sheets.

I claim:

1. A process for producing grain oriented silicon sheet steel comprising the steps of;

a. producing a heat of molten steel in a steel refining vessel consisting essentially of 0.04 maximum percent carbon, 0.010 maximum percent phosphorus, 0.010 maximum percent copper, 0.06 maximum percent nickel, 0.06 maximum percent chromium, 0.010 maximum percent molybdenum, 0.015 maximum percent tin, and sufficient manganese and sulfur as will yield a solubility product of weight percent manganese times weight percent sulfur of between 0.0007 and 0.0012;

b. tapping said heat of steel into a ladle and admixing therewith a sufficient amount of deoxidizing material to completely kill the steel;

c. adding sufficient silicon to the steel as will provide a silicon content of from 2.5 to 3.5 percent;

d. thereafter adding metallic aluminum to the killed and alloyed steel in an amount of from 0.15 to 0.52 pounds of aluminum per ton of steel;

e. thereafter teeming said steel into at least one ingot mold in an ambient atmosphere so that the aluminum added at step d is oxidized in preference to oxidation of iron, and to some extent, silicon to yield a soluble aluminum content in the ingot of no more than about 0.003 percent;

f. when the ingot has solidified, stripping the ingot from the ingot mold;

g. hot rolling said ingot into a steel slab;

h. heating said steel slab to a temperature 2,130° to 2,390° F and hot rolling said heated slab to hot band gauge;

i. cleaning mill scale from the surface of said hot rolled steel;

j. cold rolling said steel to final gauge using a two step cold roll with an intermediate anneal and providing a cold reduction of from 44 to 56 percent in the second cold rolling step;

k. annealing the steel in a decarburizing atmosphere to effect a carbon content of .007 maximum percent, and to effect primary recrystallization;

l. box annealing said steel at a temperature of 1,950° to 2,150° F to effect secondary recrystallization to a cube-on-edge oriented microstructure.

2. A process according to claim 1 in which only sufficient manganese and sulfur are provided in the steel heat as will yield a solubility product of weight percent manganese times weight percent sulfur of 0.0007 to 0.0010.

3. A process according to claim 1 in which about 0.08 weight percent manganese and about 0.009 to 0.013 weight percent sulfur is provided in said steel heat.

4. A process according to claim 1 in which about 0.07 weight percent manganese and about 0.011 to 0.015 weight percent sulfur is provided in said steel heat.

5. A process according to claim 1 in which said steel salb is heated from 2,260° to 2,390° F prior to hot rolling said slab to hot band gauge.

6. A process according to claim 2 in which said steel slab is heated from 2,260° to 2,290° F prior to hot rolling said slab to hot band gauge.

7. A process according to claim 1 in which said steel hot rolled to hot band gauge is normalized for about one minute at a temperature of at least 1,800° F prior to cold-rolling and said intermediate anneal is effected at 1,600° to 1,650° F.

* * * * *